US010424424B2

(12) United States Patent
Farrell et al.

(10) Patent No.: US 10,424,424 B2
(45) Date of Patent: Sep. 24, 2019

(54) COAXIAL RADIO FREQUENCY CONNECTORS FOR HIGH-POWER HANDLING

(71) Applicant: THE BOEING COMPANY, Chicago, IL (US)

(72) Inventors: James T. Farrell, Hermosa Beach, CA (US); Thomas E. Musselman, Thousand Oaks, CA (US); Martin W. Bieti, Tujunga, CA (US); Paul J. Tatomir, Palm Desert, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/626,039

(22) Filed: Jun. 16, 2017

(65) Prior Publication Data

US 2018/0366242 A1 Dec. 20, 2018

(51) Int. Cl.

| | |
|---|---|
| ***H01R 24/40*** | (2011.01) |
| ***H01B 11/18*** | (2006.01) |
| ***H01R 13/6584*** | (2011.01) |
| *H01R 24/56* | (2011.01) |

(52) U.S. Cl.

CPC ..... *H01B 11/1834* (2013.01); *H01B 11/18* (2013.01); *H01R 13/6584* (2013.01); *H01R 24/40* (2013.01); *H01R 24/56* (2013.01)

(58) Field of Classification Search

CPC ..... H01R 9/05; H01R 24/38; H01R 13/5202; H01R 13/111; H01R 13/506; H01R 43/20

See application file for complete search history.

(56) References Cited

U.S. PATENT DOCUMENTS

| | | | | |
|---|---|---|---|---|
| 4,764,130 | A * | 8/1988 | DiClemente | H01R 13/506 439/686 |
| 7,128,604 | B2 * | 10/2006 | Hall | H01R 24/542 439/578 |
| 7,229,303 | B2 * | 6/2007 | Vermoesen | H01R 13/20 439/271 |
| 7,695,321 | B2 * | 4/2010 | Cayzac | H01R 13/5219 439/607.41 |
| 8,210,863 | B2 * | 7/2012 | Johnson | H01R 13/622 439/218 |
| 8,414,327 | B2 * | 4/2013 | Mana | H01R 13/533 439/578 |

* cited by examiner

*Primary Examiner* — Xuong M Chung Trans

(74) *Attorney, Agent, or Firm* — Toler Law Group, PC

(57) ABSTRACT

Coaxial radio frequency ("RF") connectors for high-power handling are disclosed. Specifically, a high-power male coaxial connector ("HPMC") is disclosed. The HPMC includes a center conductor, an outer conductor disposed around the center conductor, an insulating layer positioned between the center conductor and the outer conductor, and a first elastomer. The outer conductor has an outer conductor front-end ("OCFE") and the insulating layer has an insulating layer front-end ("ILFE"). The first elastomer is positioned between the center conductor and the insulating layer. The insulating layer may include an insulating layer cavity ("ILC") extending inward into the insulating layer from the ILFE and the first elastomer may be within the ILC.

22 Claims, 5 Drawing Sheets

COAXIAL RADIO FREQUENCY CONNECTORS FOR HIGH-POWER HANDLING

STATEMENT REGARDING FEDERALLY SPONSORED RESEARCH AND DEVELOPMENT

The invention described herein was made in the performance of work under NASA Contract No. NNM07AB03C and is subject to the provisions of Section 305 of the National Aeronautics and Space Act of 1958 (72 Stat. 435: 42 U.S.C. 2457).

BACKGROUND

1. Field

The present disclosure is related to radio frequency connectors.

2. Related Art

A spacecraft includes numerous radio frequency ("RF") systems. These RF systems generally utilize numerous subsystems that are electrically connected to each other utilizing a plurality of RF connectors. For modern space applications, threaded Neill-Concelman ("TNC") and TNC wedge connectors are the standard type of RF connectors utilized in these RF systems for RF high power applications.

In general, the TNC connector is a threaded version of a bayonet Neill-Concelman ("BNC") connector that is a miniature quick connect and disconnect RF connector utilized for coaxial cables where the RF connector is designed to maintain the shielding that the design of the coaxial cable offers. These RF connectors include a female connector and a male connector that are electrically connected by pressing both the female connector and male connector together and holding them together either with two bayonet lugs (e.g., BNC) or via a threaded interface (e.g., TNC). Generally, TNC connectors operate at higher frequencies than BNC connectors and have better performance in the microwave frequencies.

The problem with known TNC and BNC connectors is when mated (i.e., physically and electrically connected), the male, female, or both connectors are susceptible to RF breakdown issues known generally as multipactor and ionization breakdown because of the formation of air gaps within the connector interface. These problems increase when higher power RF signals are transmitted through these types of RF connectors and/or these RF connectors are utilized in environments that have very cold temperatures because the dielectrics in the RF connectors typically contract with colder temperatures increasing the presence or size of the gaps. As such, there is a need for an improved RF connector that solves these problems.

SUMMARY

Coaxial radio frequency ("RF") connectors for high-power handling are disclosed. Specifically, a high-power male coaxial connector ("HPMC") is disclosed. The HPMC includes a center conductor, an outer conductor disposed around the center conductor, an insulating layer positioned between the center conductor and the outer conductor, and a first elastomer. The outer conductor has an outer conductor front-end ("OCFE") and the insulating layer has an insulating layer front-end ("ILFE"). The first elastomer is positioned between the center conductor and the insulating layer. The insulating layer may include an insulating layer cavity ("ILC") extending inward into the insulating layer from the ILFE and the first elastomer may be within the ILC.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Disclosed are coaxial radio frequency ("RF") connectors for high-power handling. Specifically, a high-power male coaxial connector ("HPMC") is disclosed. The HPMC includes a center conductor, an outer conductor disposed around the center conductor, an insulating layer positioned between the center conductor and the outer conductor, and a first elastomer. The outer conductor has an outer conductor front-end ("OCFE") and the insulating layer has an insulating layer front-end ("ILFE"). The first elastomer is positioned between the center conductor and the insulating layer. The insulating layer may include an insulating layer cavity ("ILC") extending inward into the insulating layer from the ILFE and the first elastomer may be within the ILC.

Figure 1B:
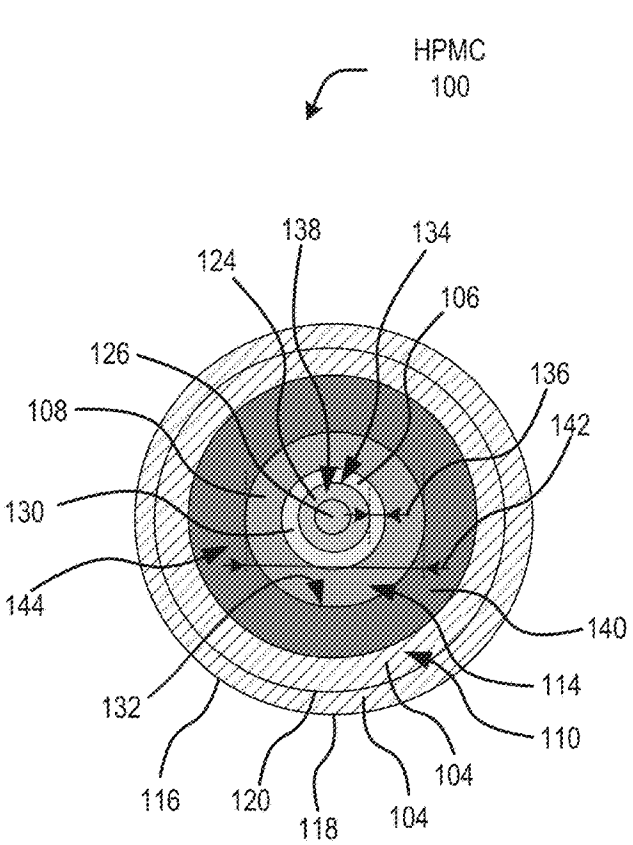
FIG. 1B is a front-view of an example of an implementation of the HPMC shown in FIG. 1A in accordance with the present disclosure.
Figure 1A:
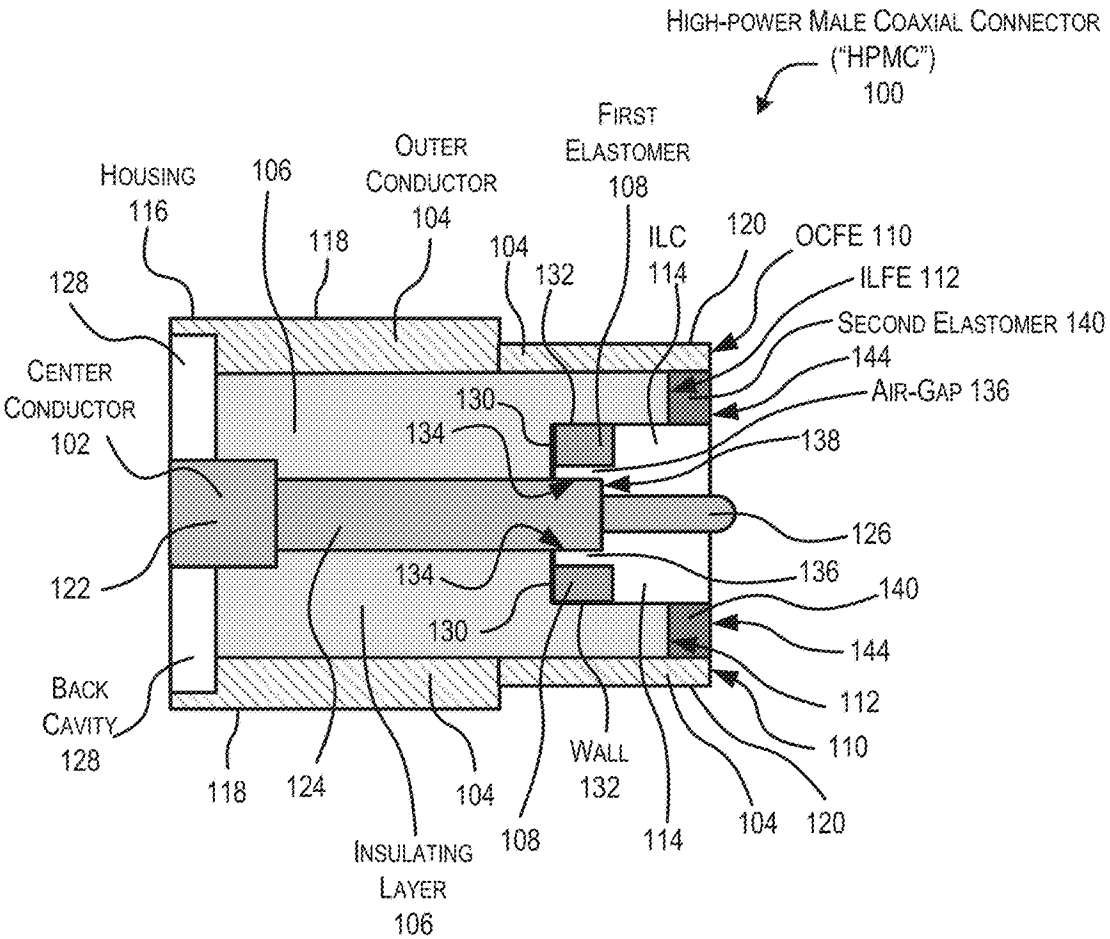
FIG. 1A is a sectional side-view of an example of an implementation of a high-power male coaxial connector ("HPMC") in accordance with the present disclosure.

In FIG. 1A, a section side-view of an example of an implementation of a high-power male coaxial connector ("HPMC") 100 is shown in accordance with the present disclosure. Similarly, in FIG. 1B, a front-view of the HPMC 100 is shown in accordance with the present disclosure. In this example, the HPMC 100 includes a center conductor 102, an outer conductor 104, an insulating layer 106, and a first elastomer 108. The outer conductor 104 is disposed around the center conductor 102, where the outer conductor 104 has an outer conductor front-end ("OCFE") 110. Moreover, the insulating layer 106 has an insulating layer front-end ("ILFE") 112 and an insulating layer cavity ("ILC") 114. In this example, the first elastomer 108 is positioned between the center conductor 102 and the insulating layer 106 within the ILC 114. The outer conductor 104 may be part of a housing, frame, casing, chassis, body, enclosure, or other similar component (herein generally referred to as a "housing" 116) of the HPMC 100. The outer conductor 104 may include any conductive material capable of electrically conducting a current such as, for example, a metal material (such as, for example, copper, silver, gold, aluminum, steel, or any similar conductive alloy). In this example, since the outer conductor 104 may be part of the housing 116 of the HPMC 100, the housing 116 may have a first portion 118 of the housing 116 and a second portion 120 of the housing 116. The second portion 120 of the housing 116 may be configured to enter and attach on to a high-power female coaxial connector ("HPFC") (not shown). The second portion 120 of the housing 116 may include, for example, a bayonet attachment mechanism, notch, or threaded screw portion. The first portion 118 of the housing 116 may be utilized, for example, to twist, turn, or screw on the second portion 120 of the housing 116 when attaching the MPMC 100 to a HPFC. As an example, the housing 116 may include an outer housing enclosure that encloses the outer conductor 104 within the outer housing enclosure. The housing 116 may be a bayonet Neill-Concelman ("BNC"), threaded Neill-Concelman ("TNC"), or a sub-miniature version A ("SMA") type RF connector housing.

In this example, the center conductor 102 includes an attachment-portion 122 of the center conductor 102, a center-portion 124 of the center conductor 102, and a front-portion 126 (generally known as a "pin") of the center conductor 102. The attachment-portion 122 may be a part of the center conductor 102 that is electrically and physically connected to a center conductor (not shown) of a coaxial cable (not shown). In this example, the HPMC 100 may include a back cavity 128 within the housing 116 to properly accommodate the physical attachment of the coaxial cable. The center-portion 124 may be a solid cylindrical portion of the center conductor 102 that extends out from attachment-portion 122 to the front-portion 126. In this example, the diameters of the attachment-portion 122, center-portion 124, and front-portion 126 may be equal to varying in size based on the desired design of the HPMC 100 and corresponding HPFC. Similar to the outer conductor 104, the center conductor 102 may include any conductive material capable of electrically conducting a current such as, for example, a metal material (such as, for example, copper, silver, gold, aluminum, steel, or any similar conductive alloy). The insulating layer 106 may be any dielectric material utilized for radio-frequency ("RF") coaxial cable applications that may include, for example, fluorocarbon materials such as, for example, polytetrafluoroethylene ("PTFE").

In this example, the first elastomer 108 is located adjacent to a bottom surface 130 and a wall 132 of the ILC 114. The first elastomer 108 is also located adjacent to a surface 134 of the center-portion 124 of the center conductor 102; however, the first elastomer 108 is constructed of an elastomer material formed of a ring (i.e., a ring-shaped washer gasket) having an opening that surrounds the center-portion 124 of the center conductor 102. In some situations, the opening of the ring of the first elastomer 108 may have a diameter that does not cause the first elastomer 108 to physically press against both the wall 132 of the ILC 114 and the surface 134 of the center-portion 124 creating a small radial air-gap 136 between the inner surface of the opening of the ring of the first elastomer 108 and the surface 134 of the center-portion 124 of the center conductor 102. In other words, the first elastomer 108 may be positioned between the center conductor 102 and the insulating layer 106 within the ILC 114 in a way that creates the radial air-gap 136 between the first elastomer 108 and the center conductor 102. Moreover, the first elastomer 108 may have a height (i.e., a thickness in the direction that is perpendicular to the direction of the diameter of the ring) that extends out from the bottom surface 130 of the ILC 114 further than a transition 138 from the center-portion 124 to the front-portion 126 of the center conductor 102. In general, if there is a radial air-gap 136 present, once the HPMC 100 is physically connected to the HPFC, the HPMC 100 is designed to allow the first elastomer 108 to approximately fill in the radial air-gap 136 with the material of the first elastomer 108 when the first elastomer 108 is compressed in a normal direction towards the bottom surface 130 of the ILC 114. In this example, the compression of the first elastomer 108 is the result of physically connecting the HPMC 100 to the HPFC since the height (i.e., thickness) of the first elastomer 108 will be slightly oversized as compared to the material that would be present in a standard known RF connector. The first elastomer 108 may be natural rubber or a polymer material with viscoelasticity (i.e., having both viscosity and elasticity) that is relatively soft and deformable. Examples of the first elastomer 108 may include natural rubber or polyisoprene, polybutadiene, polyisobutylene, polyurethanes, vulcanizing ("RTV") silicone, and other similar materials. In the case of RTV silicone, the first elastomer 108 may be constructed of CV-2289 material produced by NUSIL™ Technology LLC of Carpinteria, Calif.

The HPMC 100 may also include a second elastomer 140 positioned between the center conductor 102 and the outer conductor 104. In this example, the second elastomer 140 is positioned adjacent to the ILFE 112 outside of the ILC 114. Similar to the first elastomer 108, the second elastomer 140 may be natural rubber or a polymer material with viscoelasticity (i.e., having both viscosity and elasticity) that is relatively soft and deformable. Examples of the first elastomer 108 may include nature rubber or polyisoprene, polybutadiene, polyisobutylene, polyurethanes, RTV silicone, and other similar materials. In the case of RTV silicone, the second elastomer 140 may also be constructed of CV-2289 material produced by NUSIL™ Technology LLC of Carpinteria, Calif. In this example, the second elastomer 140 is also constructed as a ring having an opening that surrounds the front-portion 126 of the center conductor 102. The opening of the ring on the second elastomer 140 will have an inner diameter that is approximately equal to an ILC diameter 142 of the opening of the ILC 114. The second elastomer 140 has a height (i.e., thickness) that is approximately equal to or greater than the difference between the OCFE 110 and ILFE 112 such that the when the second elastomer 140 is placed adjacent to the ILFE 112 the outer surface 144 of the second elastomer 140 is approximately coplanar with the OCFE 110 or slightly protrudes out past the plane of the OCFE 110. Similar to the first elastomer 108, the second elastomer 140 is configured to be compressed as the result of physically connecting the HPMC 100 to the HPFC and may be slightly oversized as compared to the material that would be present in a standard known RF connector.

In these examples, the first elastomer 108 and second elastomer 140 are compressible dielectric rings (because elastomers are dielectrics) that reduce air gaps (including the radial air-gap 136) at the end of the pin (i.e., front-portion 126 of the center conductor 102) within the HPMC 100 so as to reduce RF breakdowns such as, for example, multipactor and ionization breakdown. As an example, the HPMC 100 may be significantly resistant to both multipactor and corona from low frequencies up to approximately 6 GHz because as the air gaps are reduced or eliminated; the possibility of resonant electron effects correspondingly decreases or is eliminated. As such, in these examples, the first elastomer 108 and second elastomer 140 minimize the possibility of gaps in high electric field (i.e., high radiated electrical flux) areas in mated (i.e., electrically connected) RF connector pairs (i.e., the HPMC 100 and a HPFC). This approach significantly reduces the RF breakdown thresholds for the HPMC 100 as compared to conventional RF connectors by removing or at least reducing all the air gaps within the HPMC 100 to allow breakdown-free or at least reduced breakdown operation of the HPMC 100 at the frequencies of operation of the HPMC 100.

In addition to filling in air gaps via mechanical compression when attaching the HPMC 100 to a HPFC, the first elastomer 108 and second elastomer 140 self-adjust over temperature to keep the air gaps filled when the insulation layer 106 shrinks with cold temperatures since the insulation layer 106 is typically made of solid rigid materials (as listed earlier) that shrink with decreased temperature. Since the first elastomer 108 and second elastomer 140 are constructed of resilient material, the material closes out or reduces the radial air gaps in a controlled fashion since for a temperature change that goes from room temperature to cold, most rigid dielectric materials contract to form gap opening but elastomers under compression from these dielectric materials release the compression to fill in the gaps formed by the rigid dielectric materials.

In an example of operation, the HPMC 100 is configured to propagate a transverse electric magnetic ("TEM") mode high-power RF signal either from a coaxial cable electrically connected to the outer conductor 104 and attachment-portion 122 of the center conductor 102 to the HPFC via the outer conductor 104 and center-portion 124 and front-portion 126 of the center conductor 102 or from the HPFC to the coaxial cable through outer conductor 104 and the front-portion 126, center-portion 124, and attachment-portion 122 of the center conductor 102. It is appreciated by those of ordinary skill in the art that in the TEM mode of operation, the electrical flux of an RF signal traveling through the HPMC 100 radiate from the center conductor 102 to the outer conductor 104 (or vice versa) through the insulating layer 106, which is a dielectric layer that allows for alternating charge accumulation and discharge between the center conductor 102 and outer conductor 104 based on the power and frequency of operation of the RF signal passing through the HPMC 100. In this example, similar to the insulating layer 106, the first elastomer 108 passes a first radiated electrical flux from either the center conductor 102 (at the center-portion 124) to the outer conductor 104 or the outer conductor 104 to the center conductor 102 (at the center-portion 124) in response to a RF signal being propagated through the HPMC 100. Furthermore, the second elastomer 140 passes a second radiated electrical flux from either the center conductor 102 (at the front-portion 126) to the outer conductor 104 or the outer conductor 104 to the center conductor 102 (at the front-portion 126) in response to the RF signal being propagated through the HPMC 100. As such, unlike pressure gasket type of rings in some RF connectors, both the first elastomer 108 and second elastomer 140 are directly in the RF path of propagation of the RF signal and as such each directly affects the electrical performance of the HPMC 100 by reducing breakdown and providing better impedance matching by reducing the radial air-gap 136 and any other gaps between the HPMC 100 and the HPFC.

Without losing generality, it is appreciated by those of ordinary skill in the art that while the term "air-gap," "air gaps," "radial air gaps" have been utilized in this disclosure to represent radial gaps in the HPMC 100 that do not have material within them (such as, for example, the insulating layer 106, first elastomer 108, and second elastomer 140), these radial gaps will also include "vacuum gaps" in space applications where there is no "air" to file these radial gaps.

In these examples, the HPMC 100 may be a male TNC connector configured to mate with a standard female TNC defined by MIL-STD-348 or with a specialized HPFC. In the examples described in this disclosure the HPMC 100 have be described as mating (i.e., electrically connecting) to a HPFC; however, since the HPMC 100 may mate with standard female TNC or BNC RF connectors, it is appreciated that all of these examples will at times be referred to simply as electrically connecting to an HPFC for the purpose of simplicity without waiving the ability to mate with these different types of female RF connectors. Moreover, the HPMC 100 may be a male SMA connector configured to mate with a standard female SMA connector.

Figure 2:
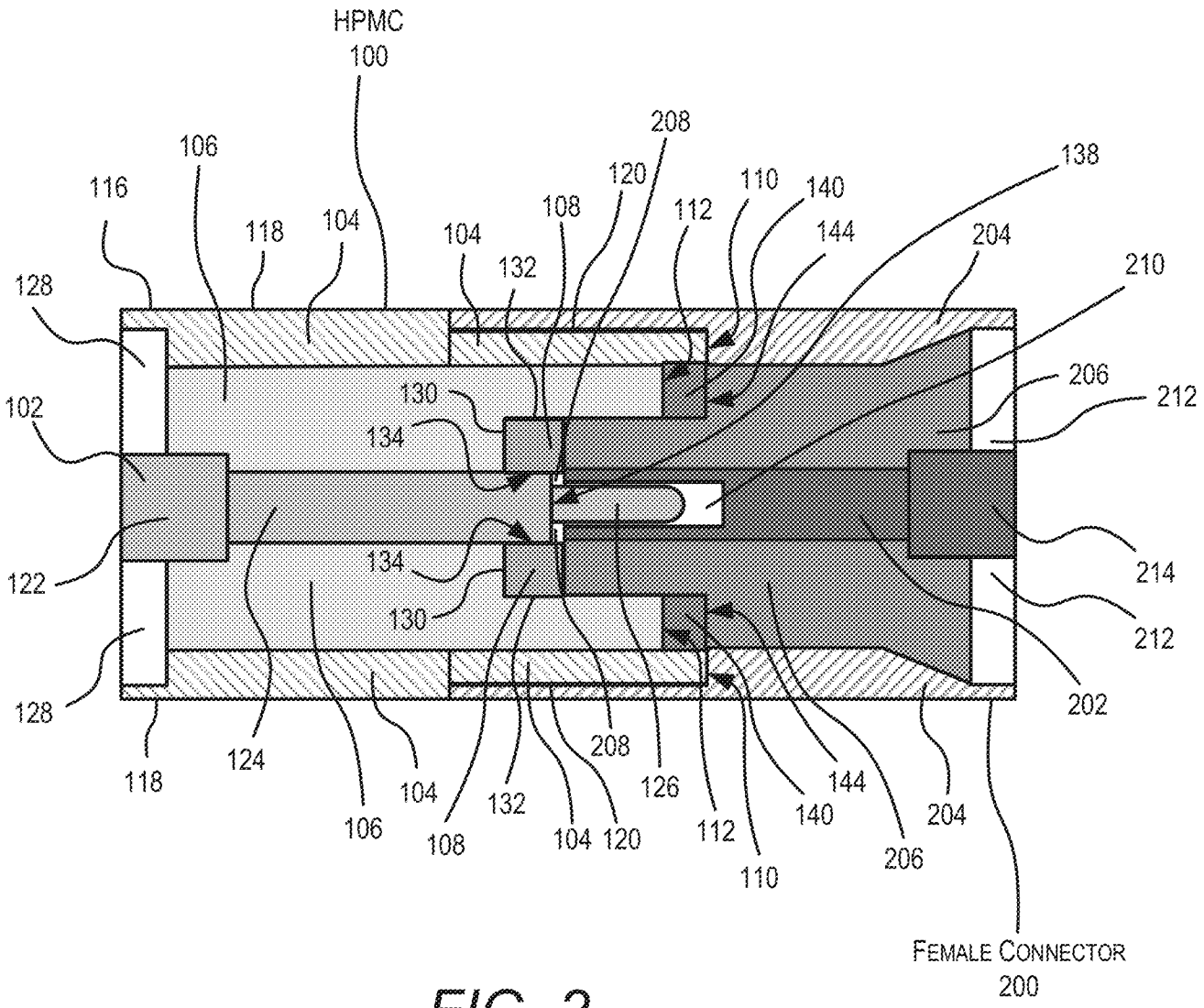
FIG. 2 is a sectional side-view of an example of an implementation of the HPMC shown in FIGS. 1 and 2 mated to a female connector in accordance with the present disclosure.

In FIG. 2, a sectional side-view of an example of an implementation of the HPMC 100 is shown mated to a female connector 200 in accordance with the present disclosure. In this example, the female connector 200 is an RF connector and may be a standard female TNC connector defined by MIL-STD-348 if the HPMC 100 is a TNC type of RF connector. Alternatively, if the HPMC 100 is a BNC type of RF connector, the female connector may be a BNC type of RF connector. Essentially, the female connector with be a type of RF connector that mates (i.e., physically and electrically connects) to the type of RF connector that the HPMC 100 is. As an example, if the HPMC 100 utilizes a threaded locking mechanism (i.e., threads that may be screwed in to the female connector 200) to mate the female connector 200, the female connector 200 will also have a corresponding threaded portion to mechanically and electrically interface with the threaded locking mechanism of the HPMC 100.

In this example, the female connector 200 includes a female center conductor 202, a female outer conductor 204, and a female insulating layer 206. The shape of the female insulating layer 206 is such that when mated to the HPMC 100, the female insulating layer 206 pushes against both the first elastomer 108 and second elastomer 140 and compresses both to eliminate or, at least reduce, any air gaps (including radial air-gap 136) within the combined assembly of the HPMC 100 and female connector 200. Specifically, in this example, the female insulating layer 206 is shaped so that a first portion of the female insulating layer 206 enters the ILC 114 and compresses the first elastomer 108 causing it to reduce in height (i.e., thickness) and flow into the radial air-gap 136 shown in FIGS. 1A and 1B filling in the radial air-gap 136 as the compressed material of the first elastomer 108 is forced to press against the surface 134 of the center-portion 124 of the center conductor 102. This effectively eliminates, or at least reduces, the radial air-gap 136. In this example, the first elastomer 108 may eliminate, or reduce, a transition air-gap 208 located between the transition 138 from the center-portion 124 to the front-portion 126 of the center conductor 102, the female center conductor 202, and the first elastomer 108. Similarly, the female insulating layer 206 is also shaped so that a second portion of the female insulating layer 206 compresses the second elastomer 140 causing it to reduce in height (i.e., thickness) and flow into any air-gaps that may be present between female insulating layer 206, second portion 120 of the outer conductor 104, and first insulating layer 106 as the compressed material of the second elastomer 140 is forced to press against ILFE 112, an inner surface of the outer conductor 104, and the female insulating layer.

In this example, the front-portion 126 of the center conductor 102 is shown residing within a conductor cavity 210 within the female center conductor 202. Similar to the HPMC 100, the female connector 200 may also include a female back cavity 212 and corresponding female attachment-portion 214 of the female center conductor 202. Similar to the HPMC 100, the female back cavity 212 and female attachment-portion 214 of the female center conductor 202 are configured to physically and electrically connect to a coaxial cable (not shown).

As discussed earlier, both the insulating layer 106 of the HPMC 100 and female insulating layer 206 of the female connector 200 are typically constructed of rigid dielectric material that has thermal characteristics that cause the rigid dielectric material to expand or contract with temperature variations. Specifically, for extreme weather, high-altitude, or space based applications, the temperature of operation may be significantly below room temperature (i.e., about 21° C.) causing the rigid dielectric material to significantly contract (i.e., shrink) causing air gaps between the interfaces of the insulating layer 106 and female insulating layer 206. The HPMC 100 utilizes the first elastomer 108 and second elastomer 140 to fill in these air gaps since both the first elastomer 108 and second elastomer 140 are of sufficient thickness that when the female connector 200 is mated with the HPMC 100, the amount of compression force applied by the female insulating layer 206 on both the first elastomer 108 and second elastomer 140 is sufficient to ensure that even at the coldest temperature of operation the combined assembly of the HPMC 100 and female connector 200, there will still be enough compression force applied on both the first elastomer 108 and second elastomer 140 to allow the material of the both the first elastomer 108 and second elastomer 140 to flow into and fill in any air gaps that are formed by the contracting rigid dielectric material of both the insulating layer 106 and female insulating layer 206.

Figure 3:
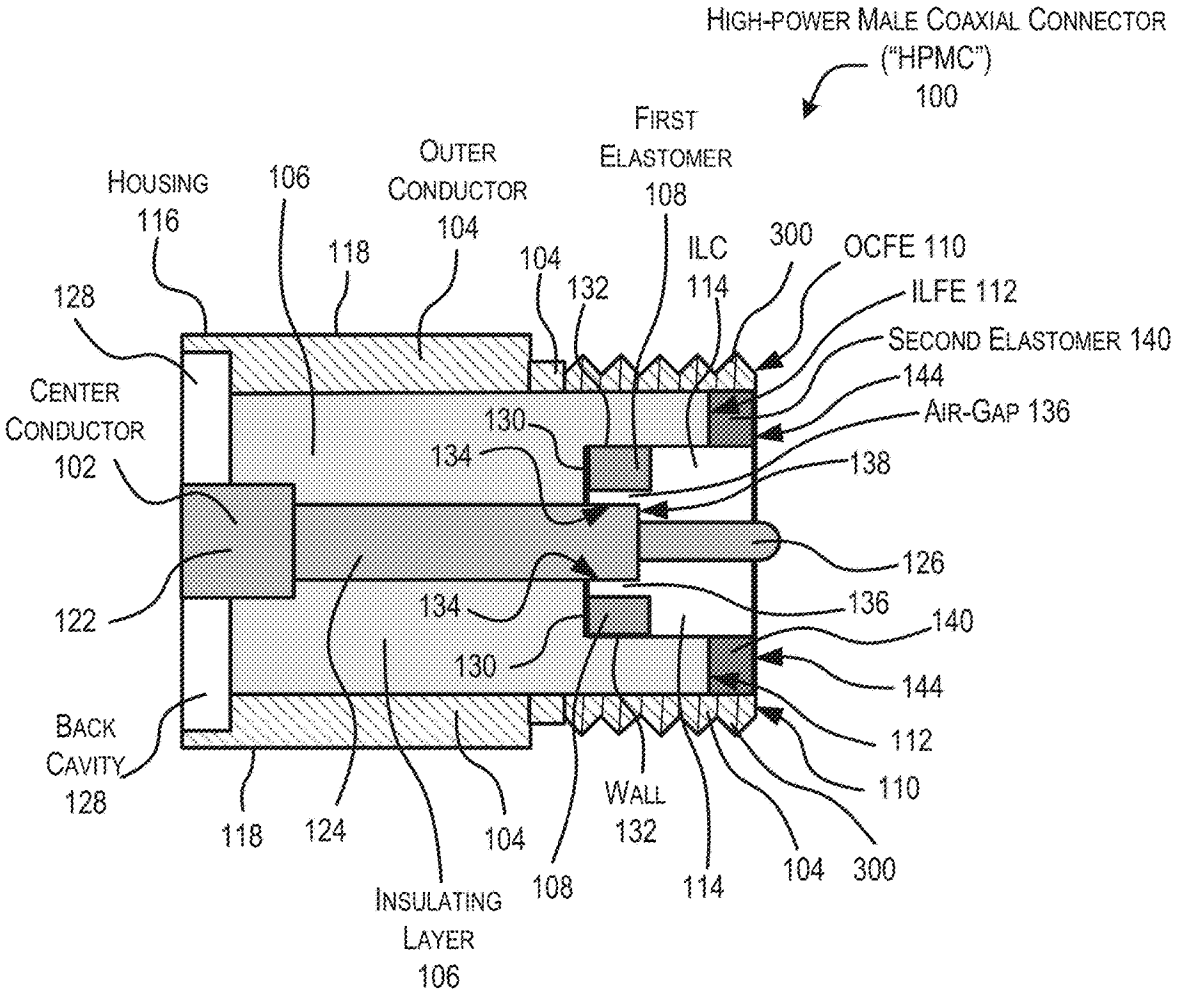
FIG. 3 is a sectional side-view of an example of an implementation of the HPMC shown in FIGS. 1A and 1B utilizing a threaded locking mechanism in accordance with the present disclosure.

Turning to FIG. 3, a sectional side-view of an example of an implementation of the HPMC 100 utilizing a threaded locking mechanism 300 is shown in accordance with the present disclosure. Similar to the examples described in relation to FIGS. 1A and 1B, in this example, the HPMC 100 also includes the center conductor 102, outer conductor 104, insulating layer 106, and the first elastomer 108. The outer conductor 104 is disposed around the center conductor 102, where the outer conductor 104 has the OCFE 110. Moreover, the insulating layer 106 has the ILFE 112 and the ILC 114. Again, in this example, the first elastomer 108 is positioned between the center conductor 102 and the insulating layer 106 within the ILC 114. As stated earlier, the outer conductor 104 is part of the housing 116 of the HPMC 100 and includes a first portion 118 of the housing 116 and a second portion 120 of the housing 116, however, in this example, the second portion 120 of the housing 116 is shown to be a threaded portion of the housing 116 that is configured to mate (i.e., both physically and electrically connect) the HPMC 100 to a female RF connector such as, for example, a HPFC or a standard female TNC RF connector. In this example, it is appreciated that the threaded portion of the housing 116 is the threaded locking mechanism 300.

Figure 4B:
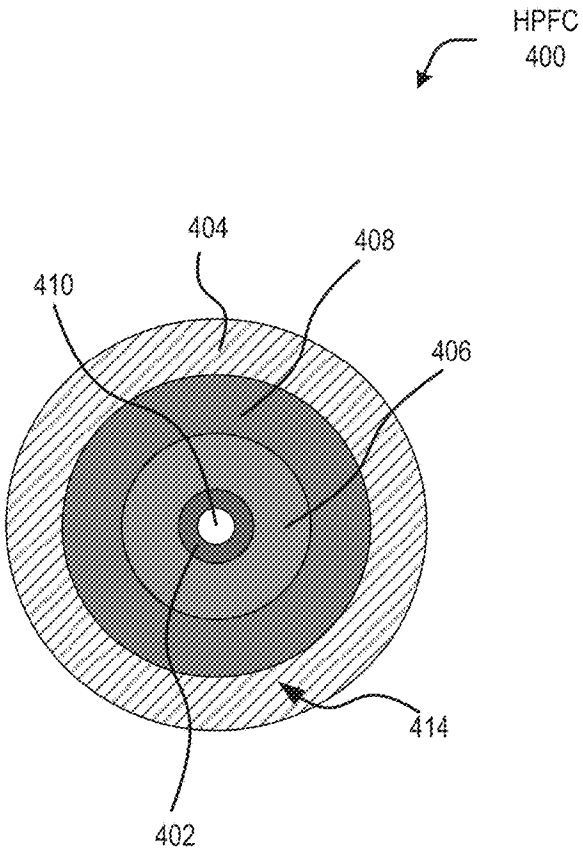
FIG. 4B is a front-view of an example of an implementation of the HPFC shown in FIG. 4A in accordance with the present disclosure.
Figure 4A:
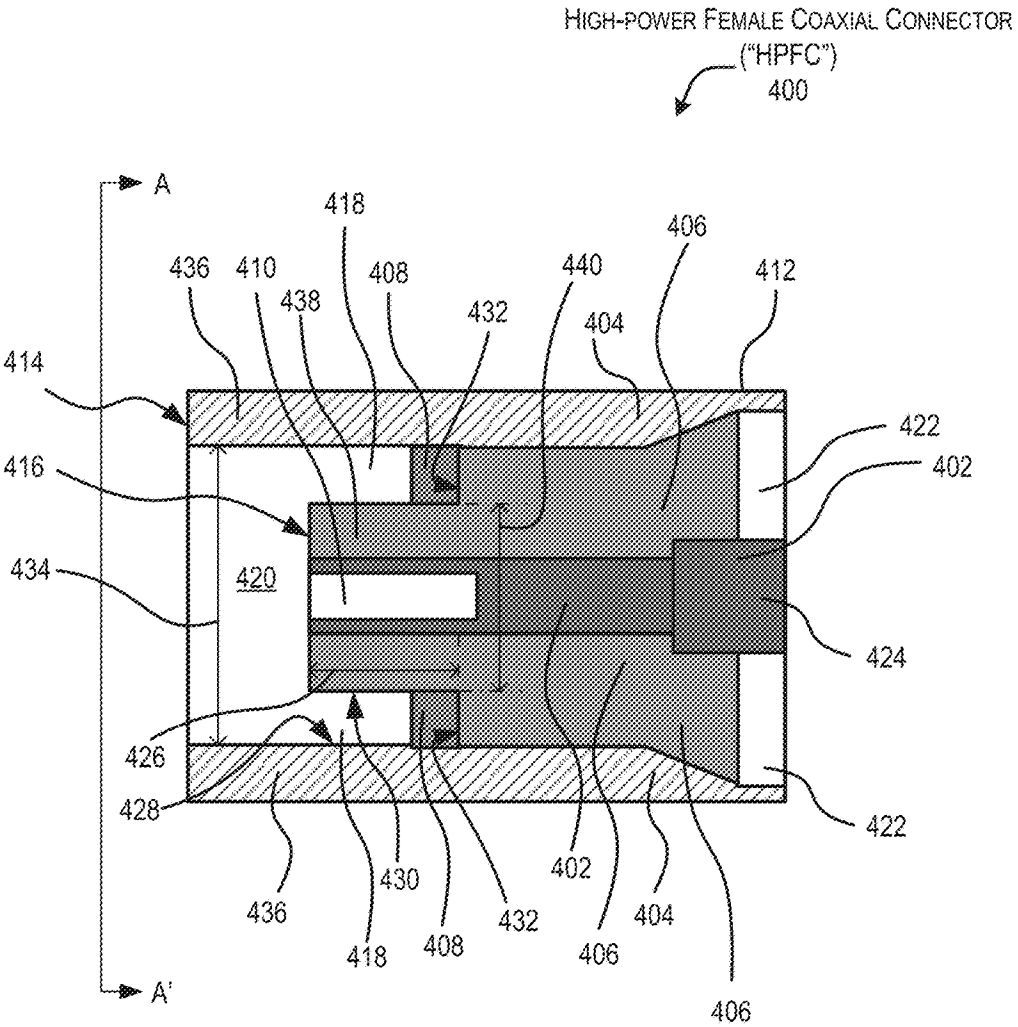
FIG. 4A is a sectional side-view of an example of an implementation of a high-power female coaxial connector ("HPFC") in accordance with the present disclosure.

In FIG. 4A, a section side-view of an example of an implementation of a HPFC 400 is shown in accordance with the present disclosure. Similarly, in FIG. 4B, a front-view of the HPFC 400 is shown along line AA' in accordance with the present disclosure. In this example, the HPFC 400 includes a female center conductor 402, a female outer conductor 404, a female insulating layer 406, and a female first elastomer 408. The female center conductor 402 includes a conductor cavity 410. The female outer conductor 404 may be part of a female housing 412 of the HPFC 400 that has a female outer conductor front-end ("FOCFE") 414 and is configured to mate with a male connector such as, for example, the HPMC 100. In this example, the female outer conductor 404 is disposed around the female center conductor 402 and the female insulating layer 406 is positioned between the female center conductor 402 and the female outer conductor 404. The female insulating layer 406 includes a female insulating layer front-end ("FILFE") 416 and a female insulating layer cavity ("FILC") 418 extending inward into the female insulating layer from the FILFE 416. In this example, the female housing 412 includes a housing cavity 420 extending inward from the FOCFE 414 into the female housing 412 that includes the FILC 418. The female first elastomer 408 is positioned between the female outer conductor 404 and the female insulating layer 406 within the FILC 418. The HPFC 400 may also include a female back cavity 422 and a female attachment-portion 424 of the female center conductor 402 similar to the description with regard to FIG. 2. In this example, the HPFC 400 may compliment an HPMC 100 that does not include a second elastomer 140.

In this example, the FILC 418 forms a ring cylinder (i.e., a cavity opening that is in the shape and form of an empty cylindrical ring) having a depth 426, an outer wall 428, an inner wall 430, a bottom surface 432, and an FILC diameter 434. The outer wall 428 is a female outer conductor portion 436 of the female outer conductor 404 and the inner wall 430 is a female insulating layer portion 438 of the female insulating layer 406. The female first elastomer 408 has a ring shape having an inner diameter 440 approximately equal to the FILC diameter 434 and is located adjacent to the bottom surface 432 and has a ring thickness. The ring thickness of the female first elastomer 408 is less than the depth 426 of the FILC 418. As discussed earlier with regards to the HPMC 100, the female first elastomer 408 is compressible and passes a radiated electrical flux from either the female center conductor 402 to the female outer conductor 404 or the female outer conductor 404 to the female first elastomer 408 in response to a RF signal being propagated through the HPFC 400. Similar to the first elastomer 108 and second elastomer 140, the female first elastomer 408 is composed of a material that selected from a group consisting of nature rubber or polyisoprene, polybutadiene, polyisobutylene, RTV silicone, and polyurethanes.

Figure 5B:
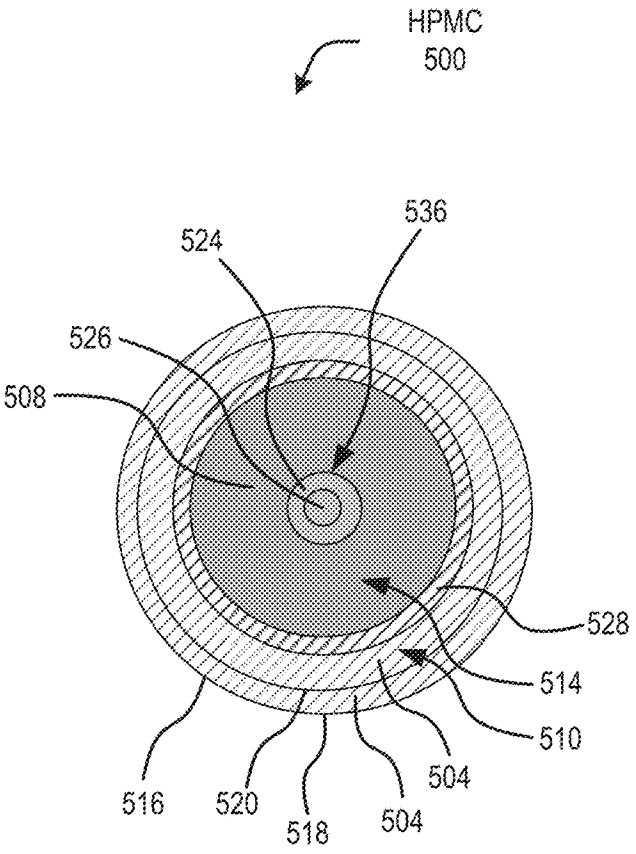
FIG. 5B is a front-view of an example of an implementation of the HPFC shown in FIG. 5A in accordance with the present disclosure.
Figure 5A:
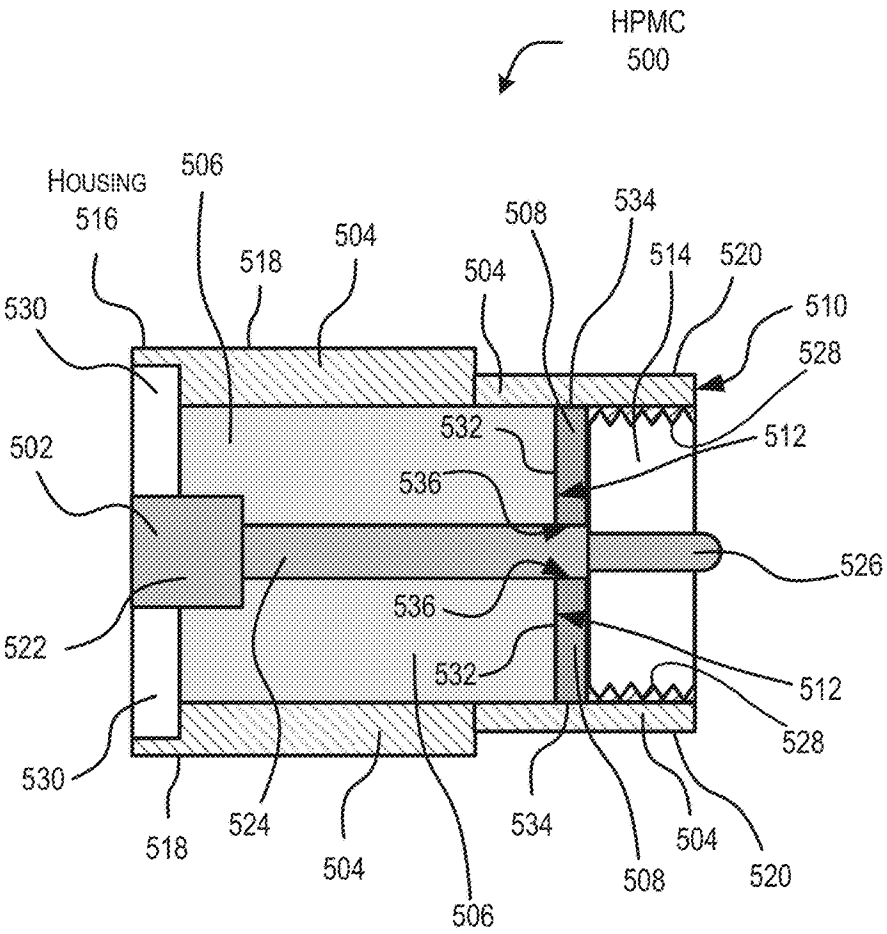
FIG. 5A is a sectional side-view of an example of another implementation of a HPFC in accordance with the present disclosure.

Similar to the example described in FIGS. 1A and 1B, in FIG. 5A, a section side-view of an example of another implementation of a HPMC 500 is shown in accordance with the present disclosure. Similarly, in FIG. 5B, a front-view of the HPMC 500 is shown in accordance with the present disclosure. In this example, the HPMC 500 includes a center conductor 502, an outer conductor 504, an insulating layer 506, and a first elastomer 508. The outer conductor 504 is disposed around the center conductor 502, where the outer conductor 504 has an OCFE 510. Moreover, the insulating layer 506 has an ILFE 512 and an ILC 514. In this example, the first elastomer 508 is positioned between the center conductor 502 and the insulating layer 506 within the ILC 514. The outer conductor 504 may be part of a housing, frame, casing, chassis, body, enclosure, or other similar component (again herein generally referred to as a "housing" 516) of the HPMC 500. As described earlier, the outer conductor 504 may include any conductive material capable of electrically conducting a current such as, for example, a metal material (such as, for example, copper, silver, gold, aluminum, steel, or any similar conductive alloy). In this example, since the outer conductor 504 may be part of the housing 516 of the HPMC 500, the housing 516 may have a first portion 518 of the housing 516 and a second portion 520 of the housing 516. The second portion 520 of the housing 516 may be configured to enter and attach on to a HPFC (not shown) or a standard female SMA connector. Similar to the previously discussed examples, the center conductor 502 includes an attachment-portion 522 of the center conductor 502, a center-portion 524 of the center conductor 502, and a front-portion 526 (generally known as the "pin") of the center conductor 502. Moreover, similar to a typical SMA connector, the HPMC 500 may also include an optional threaded locking mechanism 528 (e.g., a threaded screw portion) as part of the front-portion 522. It is appreciated by those of ordinary skill in the art that generally the optional threaded locking mechanism 528 of the HPMC 500 is a part, component, or device of the second portion 520 of the housing 516 that may include, for example, a coupling nut that is attached to the second portion 520 of the housing 516 by a snap ring coupling that allows the nut to spin about the second portion 520 of the housing 516 while applying a torsion force in the axial direction. The first portion 518 of the housing 516 may be utilized, for example, to twist, turn, or screw on the second portion 520 of the housing 516 when attaching the MPMC 500 to a female SMA connector. As an example, the housing 516 may include an outer housing enclosure that encloses the outer conductor 504 within the outer housing enclosure. The housing 516 may be a SMA type RF connector housing.

In this example, the attachment-portion 522 may be a part of the center conductor 102 that is electrically and physically connected to a center conductor (not shown) of a coaxial cable (not shown). In this example, the HPMC 500 may include a back cavity 530 within the housing 516 to properly accommodate the physical attachment of the coaxial cable. The center-portion 524 may be a solid cylindrical portion of the center conductor 502 that extends out from attachment-portion 522 to the front-portion 526. In this example, the diameters of the attachment-portion 522, center-portion 524, and front-portion 526 may be equal to varying in size based on the desired design of the HPMC 500 and corresponding HPFC or standard female SMA connector. Similar to the outer conductor 504, the center conductor 502 may include any conductive material capable of electrically conducting a current such as, for example, a metal material (such as, for example, copper, silver, gold, aluminum, steel, or any similar conductive alloy). The insulating layer 506 may be any dielectric material utilized for RF coaxial cable applications that may include, for example, fluorocarbon materials such as, for example, PTFE. In this example, the first elastomer 508 is located adjacent to a bottom surface 532 and a wall 534 of the second-portion 520 of the housing 516. The first elastomer 508 is also located adjacent to a surface 536 of the center-portion 524 of the center conductor 502; however, the first elastomer 508 is constructed of an elastomer material formed of a ring (i.e., a ring-shaped washer gasket) having an opening that surrounds the center-portion 524 of the center conductor 502. In some situations, the opening of the ring of the first elastomer 508 may have a diameter that does not cause the first elastomer 508 to physically press against both the wall 534 of the second-portion 520 of the housing 516 and the surface 536 of the center-portion 524 of the center conductor 502 creating a small radial air-gap between the inner surface of the opening of the ring of the first elastomer 508 and the surface 536 of the center-portion 524 of the center conductor 502. In other words, the first elastomer 508 may be positioned between the center conductor 502 and the outer conductor 504 within the ILC 514 in a way that creates the radial air-gap between the first elastomer 508 and the center conductor 502. Moreover, the first elastomer 508 may have a height (i.e., a thickness in the direction that is perpendicular to the direction of the diameter of the ring) that extends out from the bottom surface 532 of the ILC 514. In general, if there is a radial air-gap present, once the HPMC 500 is physically connected to the female SMA connector, the HPMC 500 is designed to allow the first elastomer 508 to approximately fill in the radial air-gap with the material of the first elastomer 508 when the first elastomer 508 is compressed in a normal direction towards the bottom surface 532 of the ILC 514. In this example, the compression of the first elastomer 508 is the result of physically connecting the HPMC 500 to the female SMA since the height (i.e., thickness) of the first elastomer 508 will be slightly oversized as compared to the material that would be present in a standard known RF connector. The first elastomer 508 may be natural rubber or a polymer material with viscoelasticity (i.e., having both viscosity and elasticity) that is relatively soft and deformable. Examples of the first elastomer 508 may include nature rubber or polyisoprene, polybutadiene, polyisobutylene, polyurethanes, RTV silicone, and other similar materials. In the case of RTV silicone, the first elastomer 108 may be constructed of CV-2289 material produced by NUSIL™ Technology LLC of Carpinteria, Calif.

In this example, the first elastomer 508 is compressible dielectric ring that reduces the radial air-gap at the end of the pin (i.e., front-portion 526 of the center conductor 502) within the HPMC 500 so as to reduce RF breakdowns such as, for example, multipactor and ionization breakdown. As described earlier, in this example, the HPMC 500 may be significantly resistant to both multipactor and corona from low frequencies because as the radial air-gap is reduced or eliminated; the possibility of resonant electron effects correspondingly decreases or is eliminated. In addition to filling in air gaps via mechanical compression when attaching the HPMC 500 to a HPFC, the first elastomer 508 self-adjusts over temperature to keep the radial air-gap filled when the insulation layer 506 shrinks with cold temperatures since the insulation layer 506 is typically made of solid rigid materials (as listed earlier) that shrink with decreased temperature. Since the first elastomer 508 is constructed of resilient material, the material closes out or reduces the radial air-gap in a controlled fashion since for a temperature change that goes from room temperature to cold, most rigid dielectric materials contract to form gap opening but elastomers under compression from these dielectric materials release the compression to fill in the gaps formed by the rigid dielectric materials.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A high-power male coaxial connector ("HPMC") comprising:

a center conductor;

an outer conductor around the center conductor, wherein the outer conductor has an outer conductor front-end ("OCFE");

an insulating layer between the center conductor and the outer conductor, wherein the insulating layer has an insulating layer front-end ("ILFE"); and a first elastomer positioned between the center conductor and the insulating layer, the first elastomer distinct from the insulating layer.

2. The HPMC of claim 1, wherein the HPMC is a sub-miniature version A ("SMA") type RF connector.

3. The HPMC of claim 1, wherein:

the insulating layer has an insulating layer cavity ("ILC") extending inward into the insulating layer from the ILFE, and the first elastomer is between the center conductor and the insulating layer within the ILC.

4. The HPMC of claim 3, wherein the first elastomer is between the center conductor and the insulating layer within the ILC to create a radial air-gap between the first elastomer and the center conductor.

5. The HPMC of claim 4, wherein the radial air-gap is a vacuum gap.

6. The HPMC of claim 4, wherein the first elastomer is compressible and configured to fill the radial air-gap when compressed.

7. The HPMC of claim 6, wherein the first elastomer is composed of a material selected from a group consisting of nature rubber, polyisoprene, polybutadiene, polyisobutylene, vulcanizing ("RTV") silicone, and polyurethanes.

8. The HPMC of claim 3, further comprising a second elastomer between the center conductor and the outer conductor, wherein the second elastomer is adjacent to the ILFE outside of the ILC.

9. The HPMC of claim 8, wherein:

the ILC has an ILC diameter, and the second elastomer has a ring shape having an inner diameter approximately equal to the ILC diameter.

10. The HPMC of claim 9, wherein the first elastomer is:

positioned between the center conductor and the insulating layer within the ILC to create a radial air-gap between the first elastomer and the center conductor:

compressible; and configured to fill the radial air-gap when compressed.

11. The HPMC of claim 3, wherein the first elastomer is configured to, in response to a radio frequency ("RF") signal, pass a first radiated electrical flux from the center conductor to the outer conductor or from the outer conductor to the center conductor.

12. The HPMC of claim 11, wherein a second elastomer is configured to, in response to the RF signal, pass a second radiated electrical flux from the center conductor to the outer conductor or from the outer conductor to the center conductor.

13. The HPMC of claim 3, wherein the HPMC is a male threaded Neill-Concelman ("TNC") connector configured to mate with a standard female TNC connector defined by MIL-STD-348.

14. The HPMC of claim 13, wherein the first elastomer is:

positioned between the center conductor and the insulating layer within the ILC to create a radial air-gap between the first elastomer and the center conductor:

compressible; and configured to fill the radial air-gap when compressed.

15. The HPMC of claim 14, further comprising a second elastomer between the center conductor and the outer conductor, wherein the second elastomer:

is adjacent to the ILFE outside of the ILC, and has a ring shape having an inner diameter approximately equal to an ILC diameter of the ILC.

16. The HPMC of claim 13, further comprising a housing having a first portion and a second portion, wherein the second portion is threaded to mate with a female connector.

17. A high-power female coaxial connector ("HPFC") comprising:

a female center conductor;

a female outer conductor around the female center conductor, wherein the female outer conductor has a female outer conductor front-end ("FOCFE");

a female insulating layer between the female center conductor and the female outer conductor, wherein the female insulating layer includes:

a female insulating layer front-end ("FILFE"); and a female insulating layer cavity ("FILC") extending inward into the female insulating layer from the FILFE; and a female first elastomer between the female outer conductor and the female insulating layer within the FILC, the female first elastomer distinct from the female insulating layer.

18. The HPFC of claim 17, wherein:

the FILC comprises a ring cylinder, the ring cylinder having an outer wall that includes a female outer conductor portion of the female outer conductor and having an inner wall that includes a female insulating layer portion of the female insulating layer, and the female first elastomer has a ring shape having an inner diameter approximately equal to a diameter of the FILC, is located adjacent to a bottom surface of the ring cylinder; and has a ring thickness less than a depth of the FILC.

19. The HPFC of claim 18, wherein the female first elastomer is compressible.

20. The HPFC of claim 19, wherein the female first elastomer is configured to, in response to a radio frequency ("RE") signal, pass a radiated electrical flux from the female center conductor to the female outer conductor or from the female outer conductor to the female first elastomer.

21. The HPFC of claim 20, wherein the female first elastomer is composed of a material selected from a group consisting of nature rubber, polyisoprene, polybutadiene, polyisobutylene, vulcanizing ("RTV") silicone, and polyurethanes.

22. The HPFC of claim 21, further comprising a female housing that is threaded to mate with a male connector.

* * * * *